United States Patent [19]

Kakehashi

[11] Patent Number: 4,503,746

[45] Date of Patent: Mar. 12, 1985

[54] SOUND EFFECT CONTROL DEVICE FOR AN ELECTRIC GUITAR

[75] Inventor: Ikutaro Kakehashi, Shizuoka, Japan

[73] Assignee: Roland Corporation, Osaka, Japan

[21] Appl. No.: 520,635

[22] Filed: Aug. 5, 1983

[30] Foreign Application Priority Data

Jan. 31, 1983 [JP] Japan ..... 58-13373[U]

[51] Int. Cl.[3] ..... G10D 3/00; G10G 5/00; G10H 1/02; G10H 3/18

[52] U.S. Cl. ..... 84/1.16; 84/267; 84/327

[58] Field of Search ..... 84/1.16, 267, 327

[56] References Cited

U.S. PATENT DOCUMENTS 3,512,443 5/1970 Parson et al. ..... 84/327 X 3,935,782 2/1976 O'Brien ..... 84/1.16

*Primary Examiner*—Stanley J. Witkowski

*Attorney, Agent, or Firm*—W. G. Fasse; D. H. Kane, Jr.

[57] ABSTRACT

An electric guitar has a band pin (1, 2) for its shoulder band. Force applied to the band pin (1, 2) through the shoulder band is converted to an electric signal by a converting means (10, 100). An effect of output sound of the electric guitar is controlled in response to the electric signal.

5 Claims, 17 Drawing Figures

SOUND EFFECT CONTROL DEVICE FOR AN ELECTRIC GUITAR

BACKGROUND OF THE INVENTION

1. Field of the Invention

The present invention relates to an electric guitar and more particularly, relates to a device for controlling the output sound effect of an electric guitar.

2. Description of the Prior Art

FIG. 1 shows an ordinary posture of playing an electric guitar. As shown in FIG. 1, ordinarily a player plays the electric guitar when the guitar is suspended from his shoulder by a shoulder band. In most cases, an electric guitar is provided with a device for controlling its output sound effect. By properly handling an operation lever 300 shown in FIG. 1, for example, a player can control the output sound effect and thus provide greater enjoyment in the performance. At this time of performance, a player in his or her excitement often swings the guitar about or pulls the shoulder band with all his strength. If such action can serve for controlling the sound effect of a guitar, it will become a very effective means for enhancing the enjoyment of the performance and making the performance much more exciting. Furthermore, in such a case, the sound effect can be controlled without handling an operation lever, and accordingly the sound effect control becomes easier.

SUMMARY OF THE INVENTION

A sound effect control device for an electric guitar in accordance with the present invention comprises a shoulder band pin for the electric guitar, a means for converting mechanical force applied to the shoulder band pin into an electric signal and a means responsive to the above described electric signal for controlling the effect of the output sound of the guitar.

Accordingly, a primary object of the present invention is to provide a sound effect control device for controlling the sound effect of an electric guitar by mechanical force applied to a shoulder band pin of the electric guitar.

The above described object and other objects and advantages will become more apparent from the following detailed description made in conjunction with the drawings.

DETAILED DESCRIPTION OF PREFERRED EXAMPLE EMBODIMENTS AND OF THE BEST MODE OF THE INVENTION

Figure 1:
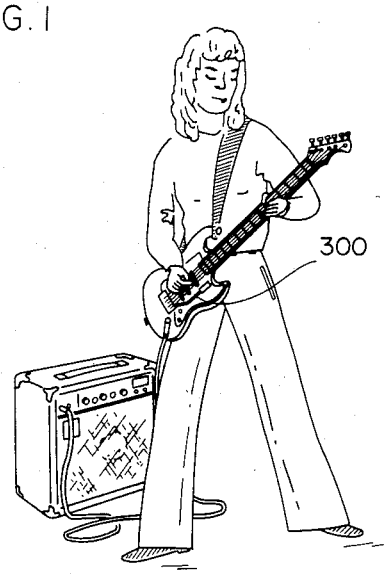
FIG. 1 shows an ordinary posture of playing an electric guitar.
Figure 2A:
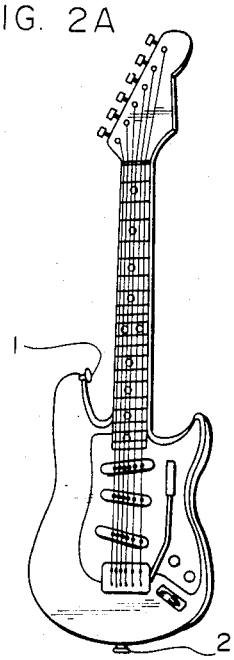
FIGS. 2A and 2B are perspective views of conventional electric guitars.
Figure 2B:
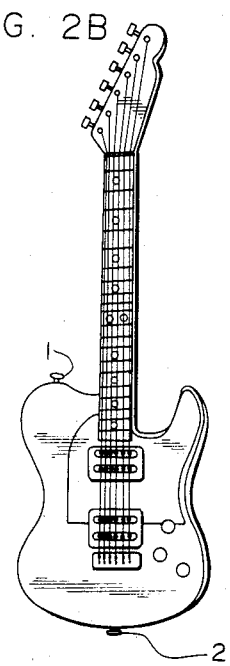

FIGS. 2A and 2B are perspective views respectively showing conventional electric guitars, in which two band pins 1 and 2 for setting a shoulder band are fixed in positions as shown in the drawing. A sound effect control device of an electric guitar in accordance with the present invention includes a mechanical-electrical converting unit which makes use of a band pin 1 or 2 as shown in FIGS. 2A and 2B, or preferably a band pin 1, as an operating element for converting mechanical movement of the operating element into an electric signal.

FIGS. 3A to 3F show a preferred embodiment of a sound effect control device for an electric guitar in accordance with the present invention. FIG. 4A shows schematically view in case where a sound effect control device of this is actually attached to an electric guitar. In this case, force is applied to a band pin 1 of an operating element 100, shown by a dotted line circle, in a direction perpendicular to the axial direction of the operating element, that is, in a direction shown by an arrow X in FIG. 4A. FIG. 4B shows an example of attachment of a sound effect control device which is another preferred embodiment of the present invention. The latter preferred embodiment will be described below with reference to FIG. 5. In either case, an operating element is provided preferably so as to be housed in the body of an electric guitar, and a shoulder band is attached with its ends to band pins 1 and 2. The band pin 1 is pulled by the shoulder band and moves in a direction of the arrow X in FIG. 4A as described above or in a direction of an arrow Y as shown in FIG. 4B for operating the sound effect control devices 100 or 10 respectively.

Figure 3A:
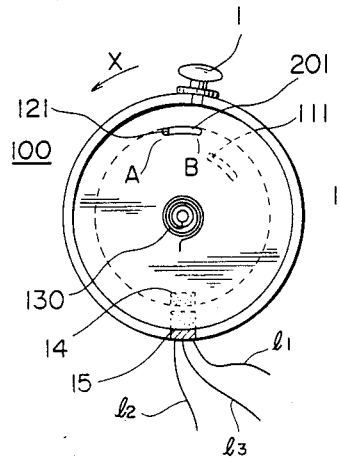
FIGS. 3A to 3F show a preferred embodiment of a sound effect control device for an electric guitar in accordance with the present invention.
Figure 3C:
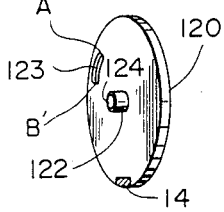
Figure 3D:
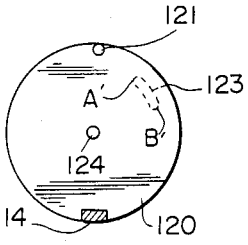
Figure 3B:
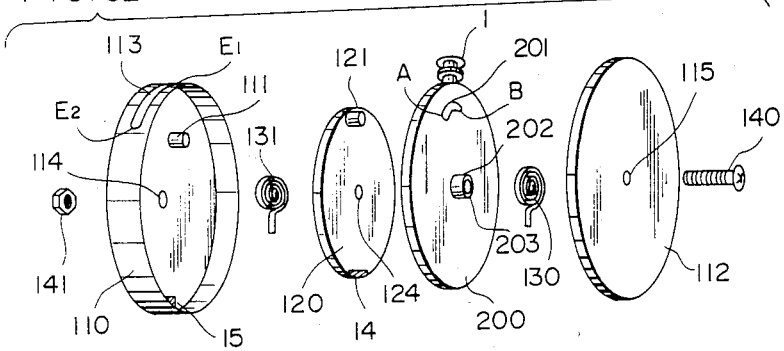
Figure 3E:
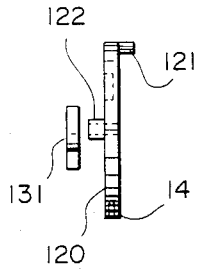
Figure 3F:
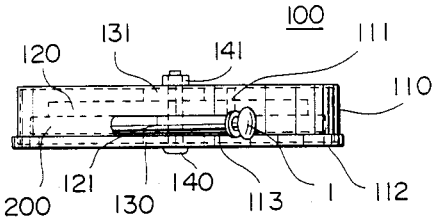
Figure 4A:
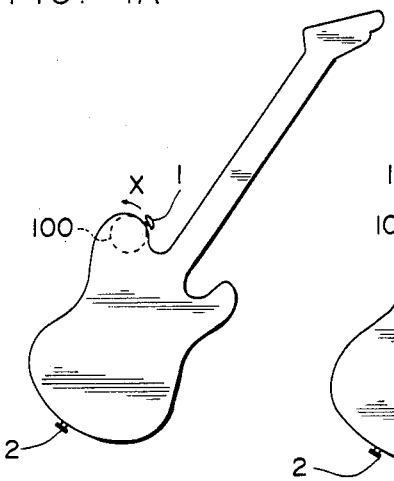
FIGS. 4A and 4B show preferred fixing positions of a sound effect control device for an electric guitar in accordance with the present invention.
Figure 4B:
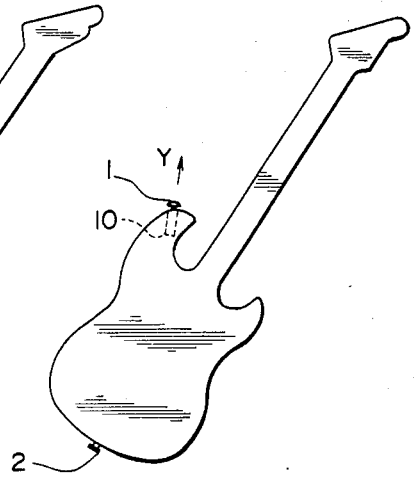

FIG. 3A is a front view of a sound effect control device 100 from which a cover 112 shown in FIG. **3*b* has been detached. FIG. 3B is a perspective, exploded view of the sound effect control device 100; FIG. 3C is a perspective view of a control plate 120; FIG. 3D is a front view of the control plate 120; FIG. 3E is a side view showing the control plate 120 and a spring 131; FIG. 3F is a plan view of the sound effect control device 100 as viewed from the side of the band pin 1**.

As can be seen from FIG. 3B, the sound effect control device 100 illustrating a preferred embodiment of the present invention, comprises a circular box 110, a spring 131, a circular control plate 120, a circular operating plate 200 having a band pin 1, a spring 130, a circular cover 112, and a bolt 140 passing through the center of these parts and a nut 141 cooperating with the bolt 140 for holding mentioned components together. The box 110 contains the spring 131, the control plate 120, the operating plate 200 and the spring 130 and is closed with the cover 112.

The circular box 110 has in the center of its bottom a hole 114 through which the bolt 140 passes. On the bottom of the box 110, a guide pin 111 is provided so as to fit in a movable manner into a groove 123 provided on one side of the control plate 120 (the side facing the bottom of the box 110; see FIGS. 3C and 3D). The side surface of the box 110 has a guide hole 113 into which a band pin 1 provided in the operating plate 200 fits in a movable manner, the moving range of the band pin 1 being limited by the guide hole 113.

The spring 131 has a central portion fixed around a protrusion 122 provided for this purpose in the center of one side of the control plate 120 (the side facing the box 110; see FIGS. 3C and 3E) and has an end fixed to the box 110. The control plate 120 has a magnet 14 located opposite to a Hall element 15 in the inner wall of the box 110. On the other side of the control plate 120 (the side facing the operating plate 200), a guide pin 121 is provided. The guide pin 121 fits in a movable manner into a guide hole 201 provided in the operating plate 200.

The Spring 130 has a central portion fixed around a protrusion 202 provided for this purpose in the center of the operating plate 200. One end of the spring is fixed to the cover 112. The bolt 140 passes through a hole 115 in the center of the cover 112, a hole 203 in the center of the protrusion 202 of the operating plate 200 around which the spring 130 is fixed, a hole 124 in the center of the protrusion 122 of the control plate 120 to which the spring 131 is fixed and a hole 114 in the center of the bottom of the box 110 and is tightened by the nut 141. FIG. 3A shows a front view of a preferred embodiment of a sound effect control device for an electric guitar in accordance with the present invention which is assembled in the above described manner and from which the cover 112 is detached. A plan view thereof as viewed from the side of the band pin 1 is shown in FIG. 3F.

The sound effect control device 100 thus assembled is attached to an electric guitar, as shown in FIG. 4A. Force is applied to the band pin 1 in a direction shown by an arrow X. Now, assuming that force is not applied, the spring 130 applies to the operating plate 200 a rotational biasing force in a direction opposite to the direction shown by the arrow X and as a result the guide pin 121 is positioned at the end A of the guide hole 201, while the spring 131 applies a rotational biasing force to the control plate 120 in a direction opposite to the arrow X and as a result the guide pin 111 is positioned at the end A' of the groove 123. In the above described state, the magnet 14 provided in the control plate 120 and the Hall element 15 provided in the box 110 are stationary in opposed positions.

When force is applied to the band pin 1 in the direction of the arrow X, the operating plate 200 rotates around the bolt 140 serving as an axis, in a manner resisting the elastic force of the spring 130 so that the guide pin 121 moves from the end A of the guide hole 201 to the end B. If force is further applied continually in the direction of the arrow X, the guide pin 121 follows the rotation of the operating plate 200 and the control plate 120 rotates in the direction of the arrow X resisting the elastic force of the spring 131. Since the movable range of the band pin 1 is limited by the guide hole 113 of the box 110, the band pin 1 departs from the end $E_1$ and reaches the end $E_2$ where it is stopped at its maximal excursion.

Thus, the operating plate 200 rotates in accordance with the movement of the band pin 1, whereas the control plate 120 does not rotate until the guide pin 121 reaches the end B of the guide hole 201. Accordingly, if and when mechanical force applied to the band pin 1 is small, the control plate 120 does not rotate and the relation between the positions of the magnet 14 and the Hall element 15 does not change. As a result, such small mechanical force applied to the band pin 1 is not detected as an electric signal by the Hall element 15. However, if and when a mechanical force applied to the band pin 1 is large, the control plate 120 rotates and the relation between the positions of the magnet 14 and the Hall element 15 is changed so that the mechanical force applied to the band pin 1 is detected as an electric signal by the Hall element 15.

The elasticity of the spring 130 is preferably selected so that the guide pin 121 cannot reach the end B of the guide hole 201 by the pulling force of the shoulder band ordinarily applied at the time of performance. Accordingly the control plate 120 rotates responsive to the rotation of the operating plate 200 only when a player pulls the shoulder band consciously, and as a result, the relation between the positions of the magnet 14 and the Hall element 15 is changed so that the mechanical force applied to the band pin 1 is detected as an electric signal by the Hall element 15. Preferably, the elasticity of the spring 131 is made to be considerably smaller than that of the spring 130 for the purpose of performing this operation easily and with efficiency.

Figure 5:
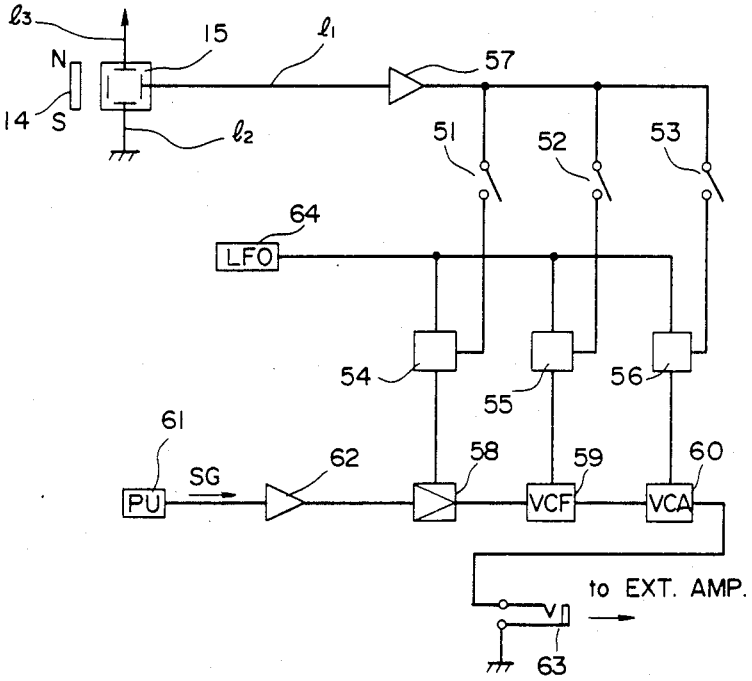
FIG. 5 shows a preferred embodiment of a sound effect control circuit for use in a sound effect control device for an electric guitar in accordance with the present invention.

FIG. 5 shows a preferred embodiment of an effect circuit using an electric signal detected by the Hall element 15. As described above, the magnet 14 and the Hall element 15 are located in opposed positions and a change in the relation between the positions is detected by the Hall element 15 as an electric signal. As shown in FIG. 3A, three lead wires $l_1$, $l_2$ and $l_3$ are connected to the Hall element 15; a voltage +B is applied to the lead wire $l_3$ and a detected signal is supplied as an output signal through the lead wires $l_1$ and $l_2$. The lead wire $l_2$ is connected to ground. The lead wire $l_1$ is connected with switches 51 to 53 through an amplifier 57. These switches are respectively connected to gate circuits 54 to 56. A low frequency oscillator 64 is connected to a frequency modulator 58 through the gate 54, to a voltage control variable cut-off frequency filter 59 through the gate 55 and to a voltage control variable gain amplifier 60 through the gate 56, respectively. A pickup 61 converts the mechanical vibrations of the strings into electric signals when the electric guitar is being played. A string vibration signals SG detected by the pickup 61 passes through the amplifier 62, the frequency modulator 58, the voltage control variable cut-off frequency filter 59 and the voltage control variable gain amplifier 60 and is transmitted to an external amplifier unit (not shown) through a plug (also not shown) connected to a jack 63.

When the band pin is pulled by a force larger than a predetermined value when the electric guitar is being played causing movement of the magnet 14, the Hall element 15 supplies the detected or generated signal through the lead wire $l_1$, and the signal is amplified by the amplifier 57. If the switch 51 is closed, a low frequency signal generated by the low frequency oscillator 64 is applied to the frequency modulator 58 through the gate circuit 54 as a control signal so that a frequency modulation, that is, a so-called vibrato effect is applied to the string vibration signal SG. If the switch 52 is closed, a low frequency signal generated in the low frequency oscillator 64, is applied as a control signal to the voltage control variable frequency filter 59 through the gate circuit 55 so that a tonal effect is applied to the string vibration signal SG. If the switch 53 is closed, a low frequency signal generated in the low frequency oscillator 64 is applied as a control signal to the voltage control variable gain amplifier 60 through the gate circuit 56 so that an amplitude modulation, that is, a so-called tremolo effect is applied to the string vibration signal SG.

Thus, even if both hands are used for playing the electric guitar, various effects can be added to the guitar sound by consciously pulling the shoulder band, which not only facilitates the playing of the guitar, but also serves effectively to enhance enjoyment of the performance. A circuit shown in FIG. 5 is generally provided in the body of an electric guitar. However, other circuits except the sound effect control device 10 (the magnet 14, the Hall element 15) and the pickup 61 may be provided as external units of an electric guitar.

Figure 6A:
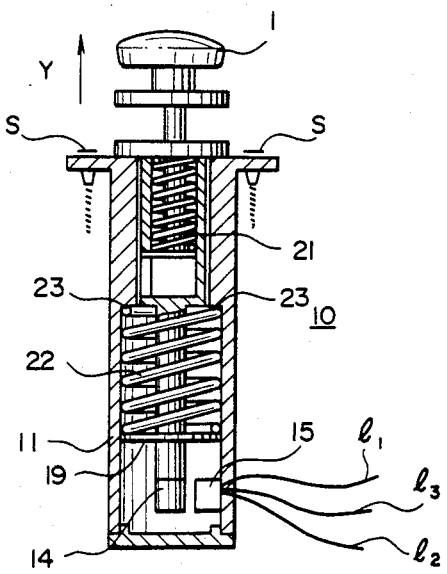
FIGS. 6A to 6E show another preferred embodiment of a sound effect control device for an electric guitar in accordance with the present invention.
Figure 6D:
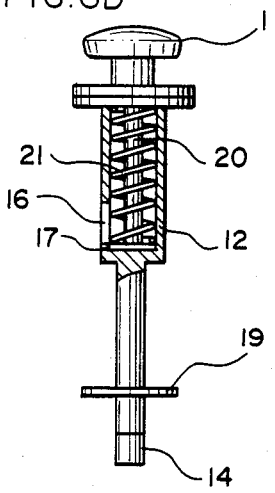
Figure 6B:
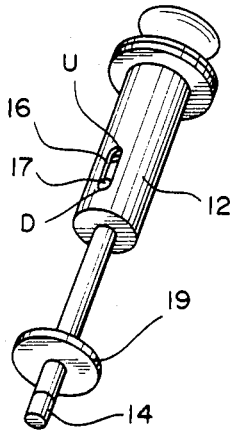
Figure 6C:
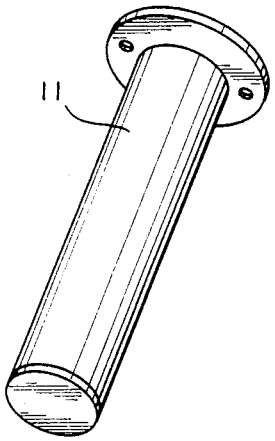
Figure 6E:
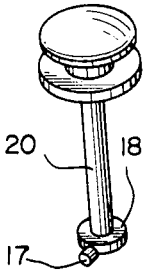

FIGS. 6A to 6E show another preferred embodiment of a sound effect control device of an electric guitar in accordance with the present invention. A sound effect control device of this embodiment is, for example, attached to an electric guitar as shown in FIG. 4B, so that the band pin 1 is pulled in the direction of the arrow Y indicating the axial direction of the band pin. FIG. 6A is an elevational view partly in section of the sound effect control device 10; FIG. 6B is a perspective view of a control rod 12; FIG. 6C is a perspective view of a box cylinder 11; FIG. 6D is a elevation partly in section of the control rod 12; FIG. 6E is a perspective view of an operating rod 20.

As shown in FIG. 6D, the operating rod 20 FIG. 6E is inserted into the control member 12. As shown in FIG. 6E, the operating rod 20 has a rim 18 provided with a guide pin 17 which fits movably into the guide hole 16 provided in the control member 12, see FIGS. 6B and 6D. The assembly of the operating rod 20 inserted into the control member 12 is disposed so that the spring 21 pushes downwardly the rim 18 of the operating rod 20, as shown in FIG. 6D. Accordingly, if and when force is not applied to the band pin 1, the rim 18 is pushed downwardly by the elastic force of the spring 21 so that the guide pin 17 is situated at the lower end D of the guide hole 16. The control member 12 has a rim 19 and the box cylinder 11 has a step portion 23 in its inner wall. The control member 12 is placed in the box cylinder 11 and a spring 22 is provided between the rim 19 and the step portion 23. In the state where force is not applied to the band pin 1, the rim 19 is pushed downward by the elastic force of the spring 22, and as a result, the control member 12 is situated in the lowermost position in the box cylinder 11 and in this position, the magnet 14 located at the top of the control member 12 is opposed to the Hall element 14 located in the inner wall of the box cylinder 11.

When a force is applied to the band pin 1, which is pulled in the direction of the arrow Y, the operating rod 20 is raised in opposition to the elastic force of the spring 21. If the elasticity of the spring 22 is made larger than that of the spring 21, the control member 12 does not move until the guide pin 17 of the operating rod 20 reaches the upper end U of the guide hole 16 of the control rod 12. If and when force is further applied to the band pin 1 after the guide pin 17 reaches the point U of the guide hole 16, the control rod 12 is raised by the guide pin 17 so that the rim 19 moves upwardly thereby resisting to the elastic force of the spring 22. Consequently, the magnet 14 at the top of the control member 12 moves and the movement is detected by the Hall element 15, which generates a detected signal at its output. The Hall element 15 is connected to lead wires $l_1$ to $l_3$ as in the embodiment in FIG. 3. A voltage +B is applied to the lead wire $l_3$ and the detected signal is supplied through the lead wires $l_1$ and $l_2$ as an output signal. The output signal thus detected is supplied to the above described circuit shown in FIG. 5, for example.

As described above, even if mechanical force is applied to the band pin 1, the control member 12 does not move until the guide pin 17 reaches the point U of the guide hole 16. Accordingly, by adjusting the elasticity of the springs 21 and 22 properly, the sound effect control device 10 can be made not to respond simply to a normal pulling force of the shoulder band ordinarily applied to the band pin 1 at the time of performance. In other words, the sound effect control device can be made to operate only when the shoulder band is pulled intentionally with a force larger than said normal pulling force.

As described above in detail, the sound effect control device of the present invention has great advantages in that the sound effect can be easily controlled even if a player uses both hands for playing the guitar and that it is very effective in increasing the enjoyment of a performance.

Although the present invention has been described and illustrated in detail, it is to be understood that the same is by way of illustration and example only and is not to be taken by way of limitation, the spirit and scope of the present invention being limited only by the terms of the appended claims.

What is claimed is:

1. A device for controlling the sound effect of an electric guitar having a guitar body, said device being disposed in said guitar body, comprising sound effect control circuit means, shoulder band pin means operatively supported on said guitar body, a shoulder band operatively secured to said shoulder band pin means, one of said shoulder band pin means being capable of moving in response to a force applied thereto through said shoulder band, and a mechanical-electrical converting means responsive to the movement of said one shoulder band pin means for converting the force applied to said one shoulder band pin means into an electric signal which is supplied to said sound effect control circuit means for controlling the output sound of said electric guiter by pulling said shoulder band.

2. The device of claim 1, wherein said mechanical-electrical converting means includes a Hall element and a magnet, said Hall element being located opposite to said magnet for detecting a change in the relative position between the Hall element and said magnet to produce said electric signal.

3. The device of claim 1, wherein the direction of movement of said one shoulder band pin means is perpendicular to a length axis of said one shoulder band pin means.

4. The device of claim 1, wherein the direction of movement of said one shoulder band pin means is parallel to a length axis of said one shoulder band pin means.

5. The device of claim 1, further comprising force threshold means as part of said mechanical-electrical converting means for enabling said mechanical-electrical converting means when a force applied to said one shoulder band pin means exceeds a predetermined value.

* * * * *